US005381746A

United States Patent [19]

Nakamura et al.

[11] Patent Number: 5,381,746

[45] Date of Patent: Jan. 17, 1995

[54] FIBER OPTIC DETECTOR AND POWER INDICATOR FOR A SEWING MACHINE

[75] Inventors: Takashi Nakamura; Satomi Yamauchi, both of Aichi; Hiroshi Honda, Nagano, all of Japan

[73] Assignee: Mitsubishi Denki Kabushiki Kaisha, Tokyo, Japan

[21] Appl. No.: 951,738

[22] Filed: Sep. 28, 1992

[30] Foreign Application Priority Data

Sep. 26, 1991 [JP] Japan ..... 3-247683

[51] Int. Cl.[6] ..... D05B 69/24; G01D 5/34

[52] U.S. Cl. ..... 112/275; 250/231.18

[58] Field of Search ..... 112/270, 220, 221, 275, 112/277, 274; 250/231.13, 231.14, 231.17, 231.18, 233; 341/13, 15; 385/5, 8, 10, 12

[56] References Cited

U.S. PATENT DOCUMENTS

| | | | |
|---|---|---|---|
| 4,231,307 | 11/1980 | Takenoya | 250/233 X |
| 4,584,954 | 4/1986 | Soyama et al. | 112/275 |
| 4,931,635 | 6/1990 | Toyama | 250/231.13 X |
| 4,987,842 | 1/1991 | Nakamura et al. | 112/275 |
| 5,015,056 | 5/1991 | Yamaguchi et al. | 250/233 X |
| 5,038,031 | 8/1991 | Kurosawa et al. | 250/231.14 |
| 5,107,107 | 4/1992 | Osborne | 250/231.14 |
| 5,168,268 | 12/1992 | Levy | 250/231.4 X |
| 5,176,085 | 1/1993 | Hara et al. | 112/275 |
| 5,233,277 | 8/1993 | Kasig et al. | 112/277 X |

FOREIGN PATENT DOCUMENTS

| | | | |
|---|---|---|---|
| 58-10080 | 1/1983 | Japan . | |
| 63-38496 | 2/1988 | Japan . | |
| 64-34397 | 2/1989 | Japan . | |
| 2218389 | 8/1990 | Japan . | |
| 4020892 | 1/1991 | Japan | 112/275 |

*Primary Examiner*—Clifford D. Crowder
*Assistant Examiner*—Ismael Izaguirre
*Attorney, Agent, or Firm*—Sughrue, Mion, Zinn, Macpeak & Seas

[57] ABSTRACT

A detector is provided for a sewing machine wherein light transmitting/shielding discs are mounted coaxially on a shaft of the sewing machine and sandwiched between light receiving and light transmitting optical fibers positioned along opposite side portions of the disc assembly and leading to a processing module section. The detector is able to detect a plurality of positional settings of the sewing machine as well as additional settings without imposing undue stress on the light transmitting optical fibers since the optical fibers remain linear. A power indicating light, connected to the processing module section via an optical fiber, ensures that there is minimal electrical interference with the operation of the detector.

11 Claims, 8 Drawing Sheets

PRIOR ART

PRIOR ART

PRIOR ART

FIBER OPTIC DETECTOR AND POWER INDICATOR FOR A SEWING MACHINE

BACKGROUND OF THE INVENTION

1. Field of the Invention

The present invention relates to a sewing machine detector for detecting, for example, the position of a sewing needle and the speed of the sewing machine. The detector is integral with the drive and control elements of the sewing machine.

2. Description of the Background Art

FIG. 8 shows one conventional sewing machine drive system, as disclosed in Japanese Patent Disclosure Publication No. 38496 (1988), including a sewing machine 1, motor 2, belt 3 for the transmission of rotation, needle section 4, control circuit section 5 for the drive control of the motor 2, detector 6 and power indicating light 100.

FIG. 9 shows, in more detail, an optical fiber type needle position detector of the conventional apparatus disclosed in Japanese Patent Disclosure Publication No. 38496 (1988) which includes a detecting section 6*a*, an optical fiber cable 6*b*, a photoelectric translation processing module section 6*c*, and electrical connectors 6*d*, 7 for connecting the module section 6*c* and control circuit section 5.

FIGS. 10 and 11 show, in more detail, the detecting section 6*a* of the conventional needle position detector shown in FIGS. 9 and 10, including a sewing machine shaft 10, a shaft 11 of the detecting section 6*a* rotated in engagement with the sewing machine shaft 10, and needle UP position and needle DOWN position detecting reflective discs 12, 13 installed on the shaft 11 for reflecting light from a needle UP position detecting optical fiber 14 and a needle DOWN position detecting optical fiber 15, respectively. FIG. 11 shows a reflecting portion 13*a* of the reflective disc 13, an optical fiber supporter 16, a light sending optical fiber 15*a* provided in correspondence with the reflecting portion 13*a* of the needle DOWN position detecting reflective disc 13, and a light receiving optical fiber 15*b* provided in correspondence with the reflecting portion 13*a* of the needle DOWN position detecting reflective disc 13. Though not shown in FIG. 11 (See FIG. 12), a light sending optical fiber 14*a* and light receiving optical fiber 14*b*, in correspondence with the reflecting area of the needle UP position detecting reflective disc 12, are also provided and perform the same functions as described above with respect to the light sending optical fiber 15*a* and light receiving optical fiber 15*b*.

FIG. 12 shows a module section 6*c* of the needle position detector including light emitting devices 20, light receiving devices 21, a light sending optical fiber 14*a* for needle UP position detection, a light receiving optical fiber 14*b* for needle UP position detection, a light sending optical fiber 15*a* for needle DOWN position detection, a light receiving optical fiber 15*b* for needle DOWN position detection, an enclosure 22 of the module section 6*c*, a circuit board 23 with light emitting devices 20 mounted thereon, electronic components 24 for a signal processing circuit, a circuit board 25 on which electronic components 24 are mounted, and a connector 6*d* for electrical connection to a control circuit section 5.

The operation of the detector will be described next. First, prior to initiating operation, the positional relationships between the UP and DOWN positions of the sewing machine needle and detector reflective discs 12, 13 must be adjusted and fixed. During operation, power is supplied from the control circuit section 5 via the connectors 7, 6*d*, and light which has been photoelectrically-translated by the light emitting devices 20 in the module section 6*c* enters the light sending optical fiber 14*a* or 15*a*, reaches the light radiating portion of the detecting section 6*a* via the optical fiber cable 6*b*, is reflected by the reflecting portion 12*a* of the reflective disc 12 or the reflecting portion 13*a* of the reflective disc 13, is received by the light receiving optical fiber 14*b* or 15*b*, returns to the module section 6*c* again, is photoelectrically-translated by the light receiving devices 21, is waveform-processed by the signal processing circuit 24, passes through the connectors 6*d* and 7 as an electrical signal, and is transmitted to the control circuit section 5 as a needle UP position or needle DOWN position signal for controlling the sewing machine.

In the conventional detector 6, the optical fibers 14, 15 act to both send and receive light to and from the detecting section 6*a* mounted in engagement with the sewing machine shaft 10 and including the reflective discs 12, 13 for indicating a sewing machine needle position, i.e., the optical fibers 14, 15 are employed solely for purposes of detection. The photoelectric translation processing module section 6*c* connected to the control circuit section 5 includes electronic parts, such as the light emitting and receiving devices 20, 21 and signal processing circuit 24, while the detecting section 6*a* and module section 6*c* are connected by optical fibers 14, 15 housed in an optical fiber cable 6*b*. With the conventional arrangement, as described above, the influence of static noise due to the friction of a fabric to be sewn as well as other noise is eliminated. Malfunction is thereby avoided and stable sewing machine operations can be performed.

In the conventional detector, as described above, light 13, sent through the light sending optical fibers 14*a* or 15*a*, is reflected by the reflecting portion of the reflective discs 12 or 13 secured to the shaft 11 and is received through the light receiving optical fibers 14*b* or 15*b*. However, the reflective discs 12, 13 must withstand constant vibration during the operation of the sewing machine 1. Furthermore, if the bearings supporting the shaft 11 are worn, the shaft 11 vibrates to an even greater extent, causing the optical axes between the optical fibers 14, 15 and the reflecting portions of the reflective discs 12, 13 to change, resulting in an inability to receive predetermined signals.

Also, since the reflecting portions of the reflective discs 12, 13 are curved, they are difficult and expensive to machine.

Further, the rotary reflective discs 12, 13 employed as components for signal detection make the detecting section 6*a* relatively thick and non-compact.

Further, in the conventional detector, since the light sending optical fibers 14*a*, 15*a* and light receiving optical fibers 14*b*, 15*b* must be flexed, as shown in FIG. 11, in consideration of the curvatures of the reflective discs 12, 13, significant stress is imposed on the optical fibers 14, 15.

Due to the elasticity of the optical fibers 14, 15, and depending on the degree of curvature of the fibers, there may be a relatively large internal force directing the fibers 14, 15 to return to their original, straight line status, which internal force, as noted above, results in a significant stress in the fibers 14, 15 in the area where the fibers 14, 15 are inserted into the optical fiber supporter. Thus, in combination with the above-mentioned vibration, there is a significant possibility that the optical fiber supporter 16 may fracture.

Furthermore, when the curvature radius is large, the light transmitting percentage of the optical fibers 14, 15 decreases, and the efficiency deteriorates. Consequently, expensive optical fibers are necessary to prevent the above described problems.

The conventional apparatus as shown in FIG. 8 also includes a power indicating light 100 having a light emitting diode and lead wires run through cable **6*b* to turn on the light emitting diode. As noted above, the optical fibers are only employed for detection purposes. By way of contrast, power is supplied by the control circuit section 5 through regular lead wires run through cable 6*b* to the power indicating light 100**.

Industrial sewing machines are often used in areas where high frequency welders are used, e.g., to seal raincoats, tents, etc. However, since high frequency welders generate high frequency electromagnetic waves of about 27 Mhz to 42 Mhz with outputs of several KW to several tens of KW, the lead wires in cable **6*b* for the power indicating light 100 can act as antennas thereby receiving the electromagnetic waves and generating an electromotive force. This electromotive force is highly undesirable as it affects the control device 5 and may cause the control device 5** to operate erroneously.

SUMMARY OF THE INVENTION

It is, therefore, an object of the present invention to overcome the above described disadvantages with respect to conventional apparatus by providing a low-price detector for a sewing machine which detector is durable despite the detrimental effects of vibration and which includes a thinner and more compact detecting section.

Another object of the present invention is to provide a detector for a sewing machine which minimizes stress imposed on the optical fibers by minimizing the curvature of the optical fibers.

Another object is to provide a power indicating light which does not electrically interfere with the operation of the detector and controller.

DESCRIPTION OF THE PREFERRED EMBODIMENTS

Figure 1:
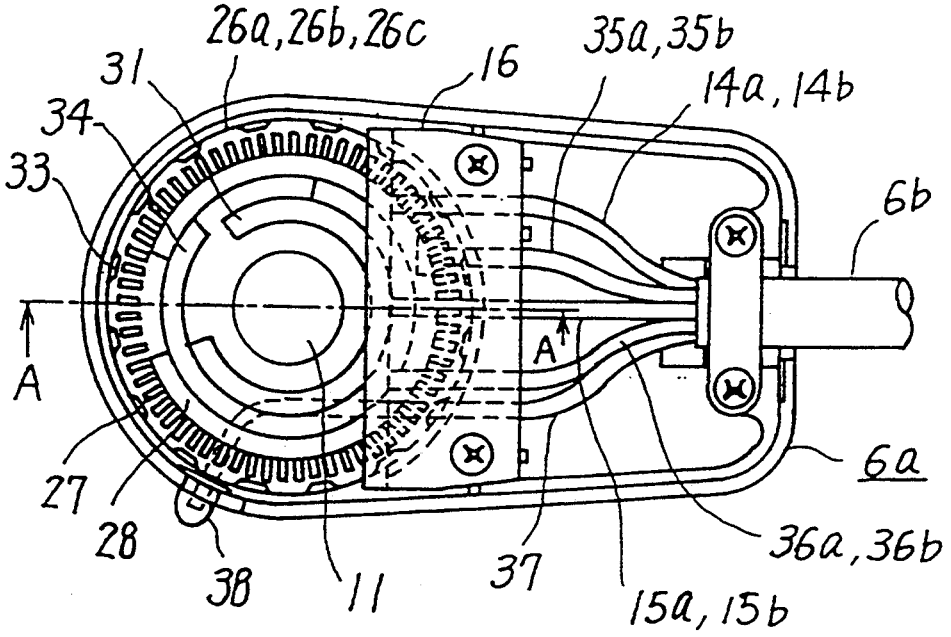
FIG. 1 is a side view of a detector for a sewing machine according to a preferred embodiment of the present invention.

A preferred embodiment of the present invention will now be described with reference to FIGS. 1–7. Flat, sheet-shaped first, second and third light shielding discs **26*a*, 26*b* and 26*c*, respectively, are mounted coaxially to a shaft 11 connected to a sewing machine shaft 10**.

The first light shielding disc **26*a* detects the sewing machine speed and a needle UP position, its base material being formed from a light-transmitting synthetic resin. A speed detecting light shielding area 27, needle UP position detecting light shielding area 28, angle setting scale 29 and angle indication 30 are printed, for example, in black on the surface of the base material (FIG. 6), the shaft 11 being secured at a shaft-through hole formed in the center of the disc 26*a***. The angle indication is provided as one tenth of the actual angle, i.e. 340° is indicated as 34°.

The second light shielding disc **26*b* is designed to detect a needle DOWN position, and its base material is also made of light-transmitting synthetic resin. A needle DOWN position detecting light shielding area 31 and an indicator arrow 32 for indicating an angle are printed on the surface of the base material, in a color different from that on the first light shielding disc 26*a* (e.g. red). Also, the outer circumference of the second light shielding disc 26*b* is provided with projections 33 such that the second light shielding disc 26*b* may be easily rotated with respect to the first disc 26*a*, the second disc 26*b* being free to rotate relative to the shaft 11 via a shaft-through hole formed in the center of the disc 26*b***.

Though not shown, the base material of the third light shielding disc **26*c* is also made of light-transmitting synthetic resin as in the first and second light shielding discs 26*a* and 26*b*. A thread trimmer timing position detecting light shielding area 34 (FIG. 1) is provided on the surface of the base material and an indicator arrow for indicating an angle is also printed on the base material in a color different from that on the first and second light shielding discs 26*a* and 26*b* (e.g. blue). The outer circumference of the third light shielding disc 26*c* is provided with projections such that the disc 26*c* may be rotated with respect to discs 26*a* and 26*b*, the third disc 26*c* being free to rotate via a shaft-through hole formed in the center of the disc 26*c* through which the shaft 11 is inserted. When the second and third discs 26*b* and 26*c*** are rotated to the proper settings, they are clamped in place by a clamp (not shown).

Figure 2:
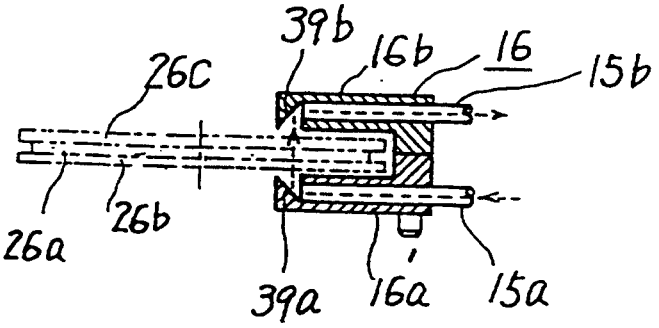
FIG. 2 is a sectional view taken along the plane A—A of FIG. 1.
Figure 3:
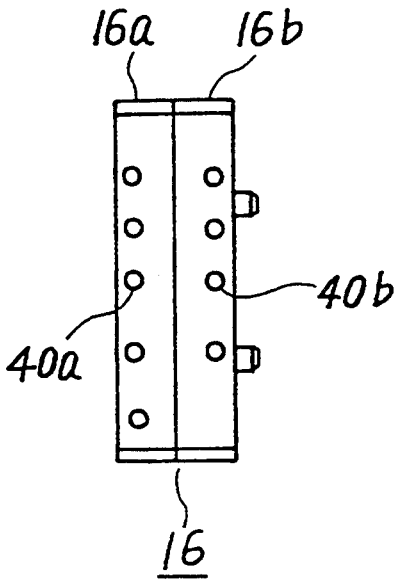
FIG. 3 is a side view of an optical fiber supporter in the sewing machine detector according to the preferred embodiment of the present invention.
Figure 4:
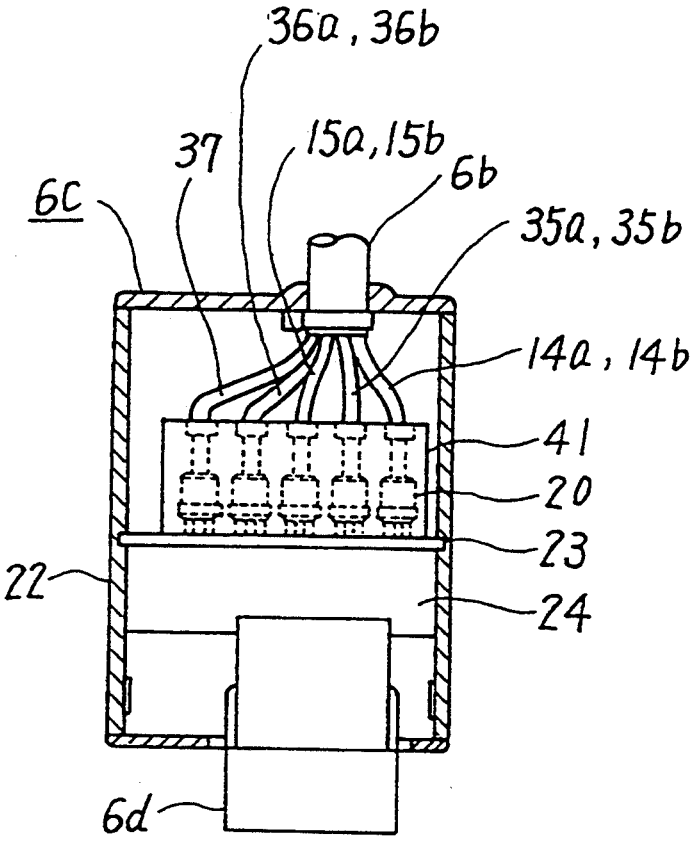
FIG. 4 is a front sectional view of a module section in the sewing machine detector according to the preferred embodiment of the present invention.

An optical fiber supporter 16, as shown in FIGS. 2 and 3, includes two optical fiber supporter pieces **16*a* and 16*b* of identical shape. The optical fiber supporter piece 16*a* is provided with linear optical fiber fixing holes 40*a* (FIG. 3) for locking the ends of the light sending optical fiber for UP position detection 14*a*, the light sending optical fiber for DOWN position detection 15***a*, the light sending optical fiber for sewing machine speed detection 35*a*, the light sending optical fiber for thread trimmer timing position detection 36*a*, and the power indicating optical fiber 37. Significantly, the fibers are not flexed when inserted in the fixing holes 40*a*. First reflecting portions 39*a* are provided opposite the end faces of the light sending optical fibers 14*a*, 15*a*, 35*a* and 36*a*, respectively. The first reflecting portions 39*a* are provided by plating or by attaching reflective plates having a reflecting portion.

The optical fiber supporter piece 16*b* is provided with linear optical fiber fixing holes 40*b* for locking the ends of the light receiving optical fiber for UP position detection 14*b*, the light receiving optical fiber for DOWN position detection 15*b*, the light receiving optical fiber for sewing machine speed detection 35*b* and the light receiving optical fiber for thread trimmer timing position detection 36*b*. Again, significantly, the fibers are not flexed when inserted in the fiber fixing holes 40*b*. Furthermore, second reflecting portions 39*b* are provided opposite to the end faces of the light receiving optical fibers 14*b*, 15*b*, 35*b* and 36*b*. The second reflecting portions 39*b* may be provided in an identical manner as described above with respect to the first reflecting portions 39*a*.

The optical fiber supporter 16 is fastened, as by a screw or the like, to the enclosure of the detecting section 6*a* such that the first reflecting portions 39*a* and second reflecting portions 39*b* are in opposition and such that the light shielding areas 27, 28, 31, 34 of the first to third light shielding discs 26*a*, 26*b*, 26*c* are disposed between the first and second reflecting portions 39*a* and 39*b* (see FIG. 2). Consequently, light transmitted from the light sending optical fibers 14*a*, 15*a*, 35*a*, 36*a*, and reflected by the first reflecting portions 39*a*, passes through the first to third light shielding discs 26*a*, 26*b*, 26*c*, is reflected by the second reflecting portions 39*b*, and enters the light receiving optical fibers 14*b*, 15*b*, 35*b*, 36*b*.

A power indicating window 38 is provided along a wall of the detecting section 6*a* so as to receive one end of the power indicating optical fiber 37. Also, a fixing block 41 is provided within the module section 6*c* for securing the light sending optical fibers 14*a*, 15*a*, 35*a*, 36*a*, 37 and the light receiving optical fibers 14*b*, 15*b*, 35*b*, 36*b*. A circuit board 23 (FIG. 5) is fixedly secured within the module section 6*c* to the light emitting devices 20 and the light receiving devices 21.

In the above described detector of the preferred embodiment, light is radiated from the light emitting devices 20 in the module section 6*c* (FIGS. 4, 5), passes through the light sending optical fibers 14*a*, 15*a*, 35*a*, 36*a*, 37 and is sent to the detecting section 6*a*. Light transmitted through the light sending optical fibers 14*a*, 15*a*, 35*a*, 36*a* is projected on the first reflecting portions 39*a* from the ends of the light sending optical fibers 14*a*, 15*a*, 35*a*, 36*a* and is reflected by the first reflecting portions 39*a* toward the first to third light shielding discs 26*a*, 26*b*, 26*c*. When the light shielding areas 27, 28, 31, 34 of the first to third light shielding discs 26*a*, 26*b*, 26*c* are in transmitting positions, light is transmitted through the first to third light shielding discs 26*a*, 26*b*, 26*c* and directed to the second reflecting portions 39*b*, then reflected by the second reflecting portions 39*b* to the light receiving optical fibers 14*b*, 15*b*, 35*b*, 36*b*. The light directed to the light receiving optical fibers 14*b*, 15*b*, 35*b*, 36*b* enters the light receiving devices 21 (FIG. 5), is photoelectrically-translated therein, and is output as an electrical signal (e.g., a low level signal) in a conventional manner.

By way of contrast, when the light shielding areas 27, 28, 31, 34 of the first to third light shielding discs 26*a*, 26*b*, 26*c* are in shielding positions, light is not transmitted through the first to third light shielding discs 26*a*, 26*b*, 26*c*, i.e., light does not reach the second reflecting portions 39*b* and is not directed to the light receiving optical fibers 14*b*, 15*b*, 35*b*, 36*b*. In this situation, the light (or its absence) is converted to an electrical signal (e.g., a high signal) by the light receiving devices 21.

Thus, a speed signal for detecting the speed of a sewing machine 1 can be detected by the speed detecting light shielding area 27; a sewing machine needle UP position by the needle UP position detecting light shielding area 28; a sewing machine needle DOWN position by the needle DOWN position detecting light shielding area 31; and a thread trimmer timing position by the thread trimmer timing position detecting light shielding area 34.

When the optical axes of the light sending optical fibers 14*a*, 15*a*, 35*a*, 36*a* and the light receiving optical fibers 14*b*, 15*b*, 35*b*, 36*b* are not precisely aligned, light does not reach the light receiving optical fibers 14*b*, 15*b*, 35*b*, 36*b*, even if the light shielding areas 27, 28, 31, 34 of the first to third light shielding discs 26*a*, 26*b*, 26*c* are in the transmitting positions. Consequently, only high level electrical signals are provided. In the preferred embodiment, however, the light sending optical fibers 14*a*, 15*a*, 35*a*, 36*a*, first reflecting portions 39*a*, second reflecting portions 39*b* and light receiving optical fibers 14*b*, 15*b*, 35*b*, 36*b* are integrally secured and fixed in position by the optical fiber supporter 16, thereby providing accurate optical axes and a constant and stable operation.

Figure 5:
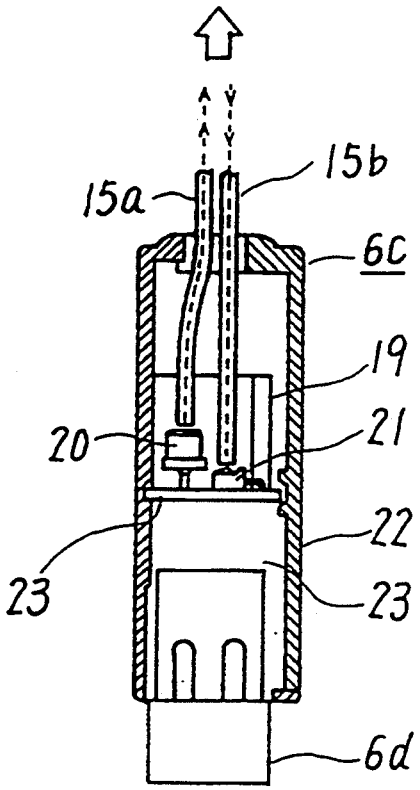
FIG. 5 is a side sectional view of the module section in the sewing machine detector according to the preferred embodiment of the present invention.
Figure 6:
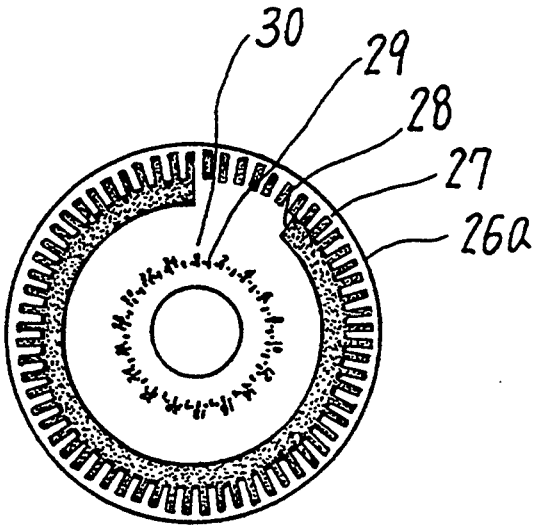
FIG. 6 is a side view of a first light shielding disc in the sewing machine detector according to the preferred embodiment of the present invention.
Figure 7:
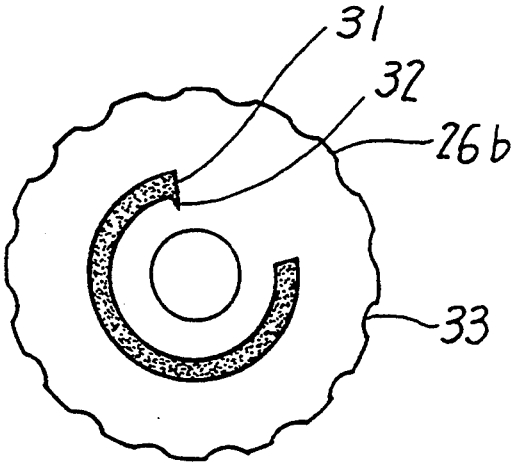
FIG. 7 is a side view of a second light shielding disc in the sewing machine detector according to the preferred embodiment of the present invention.
Figure 8:
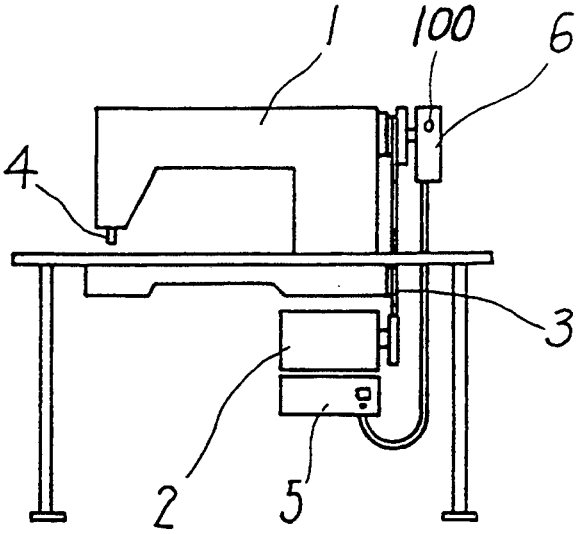
FIGURE 8 PRIOR ART
FIG. 8 is an overall view showing the arrangement of a conventional sewing machine.
Figure 9:
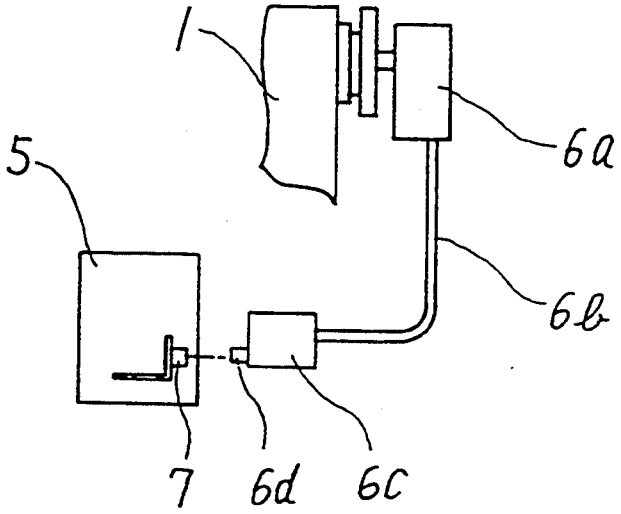
FIG. 9 is a front view of the conventional sewing machine detector shown in FIG. 8.
Figure 10:
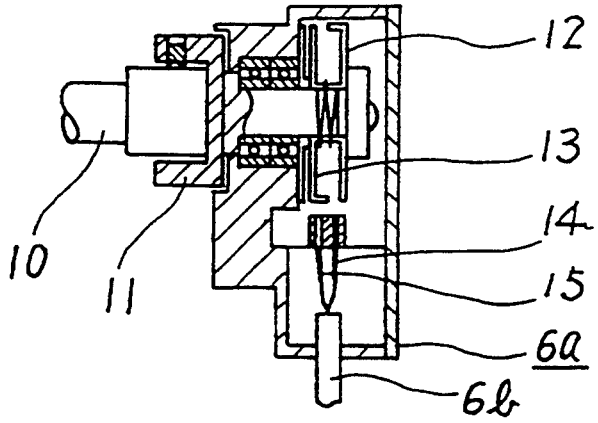
FIGURE 10 PRIOR ART
FIG. 10 is a front sectional view of the detecting section of the conventional sewing machine detector shown in FIGS. 8–9.
Figure 11:
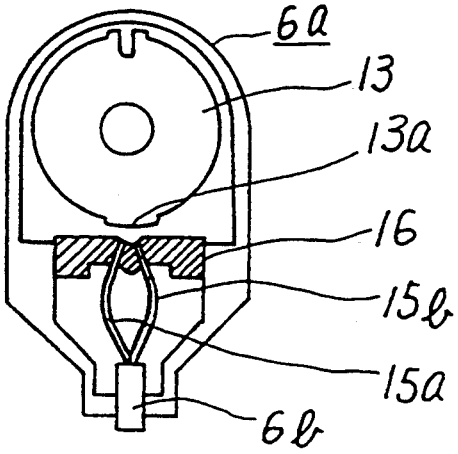
FIG. 11 is a side sectional view of the same detecting section shown in FIG. 10.
Figure 12:
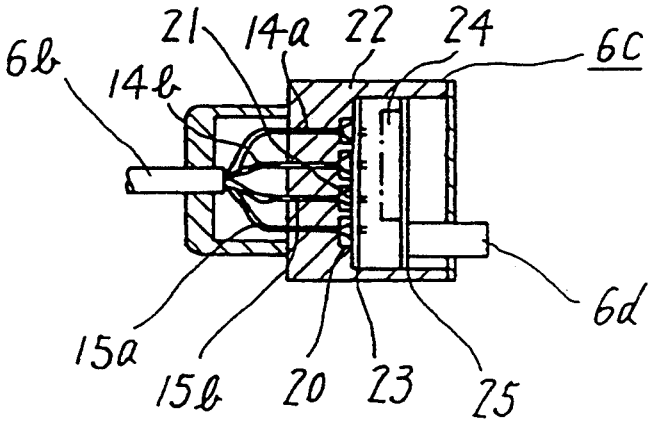
FIG. 12 is a sectional view of a module section of the conventional sewing machine detector shown in FIGS. 8–9.

Also, in the preferred embodiment, light is radiated from the light emitting device 20 in the module section 6*c* in FIG. 5, through an additional power indicating optical fiber 37, to the power indicating window 38 for power indication. Since the power indicating optical fiber runs from the module section 6*c* all the way to the detecting section 6*a*, there is no interference or "noise" problem, as is the case in the conventional detector assembly including a regular lead wire.

First to third light shielding discs 26*a*, 26*b*, 26*c* are disposed coaxially, as shown in FIG. 2, the first light shielding disc 26*a* being unrotatably secured to the shaft 11, and the second and third light shielding discs 26*b*, 26*c* being rotatably mounted to the shaft 11 when clamps (not shown) are loosened. The second and third light shielding discs 26*b*, 26*c* are unclamped from the shaft 11 only during angle adjustment. In addition, the second and third light shielding discs 26*b*, 26*c* have indicator arrows printed thereon for indicating an angle of rotation. The indicator arrows are printed in different colors so that the discs 26*a*, 26*b* and 26*c* may be differentiated. Further, the outer circumferences of the second and third light shielding discs 26*b*, 26*c* are provided with projections for manually rotating the second and third light shielding discs 26*b*, 26*c* relative to the shaft 11 and the first disc 26*a*.

As noted above, the indicator arrows of the second and third light shielding discs 26*b*, 26*c* are printed in different colors to facilitate the reading of an angle as determined with reference to the angle setting scale 29 of the first light shielding disc 26*a*. Thus, by reading the angle indication 30 (one-tenth of the actual angle) printed on the first disc 26*a*, the angles of the needle UP signal, needle DOWN signal and thread trimmer timing are easily determined.

It should be noted that the light-transmitting base materials of the first to third light shielding discs 26*a*, 26*b*, 26*c* may, alternatively, be non-light-transmitting and include drilled portions where light is to be transmitted.

It should be noted that signals other than the four signals detected, i.e. needle UP position signal, needle DOWN position signal, speed detection signal and thread trimmer position detection signal, may also be detected, and that at least two or more of the signals may be detected simultaneously.

It should also be noted that the reflecting portions 39*a*, 39*b*, provided in two places in the first embodiment, may, alternatively, be provided in one place if the positions and reflecting angles of the reflecting portions are such that the ends of the optical fibers are supported linearly so as to reduce stress in the optical fibers.

The present invention, unlike the conventional apparatus having rotary reflective discs, is capable of stably detecting sewing machine control signals despite shaft vibration due to the excessive wear.

Also, since there is no need for curved reflecting portions on the reflective discs, the present invention is less expensive to manufacture and results in a thinner, more compact detecting section.

It should also be noted that the present detector significantly reduces stress imposed on the optical fibers since the fibers are supported linearly. Also, stationary reflecting portions enable optional and additional optical axes to be generated.

Also, the present invention provides for the easy generation, during assembly, of accurate optical axes, which accuracy is maintained for long periods of time.

The present invention also includes an optical fiber power indicating cable which does not interfere or adversely affect sewing machine control circuitry. Furthermore, the power indicating cable can be run simultaneously with the optical fibers for detection, thereby simplifying the construction.

What is claimed is:

1. A detector for a sewing machine, said detector comprising:

a photoelectric translation processing module section including a power indicating light emitting device and a power/signal connector;

a detecting section optically connected with said photoelectric translation processing module section via a cable section and including a power indicating window; and a power indicating optical fiber disposed within said cable section, optically connecting said photoelectric translation processing module section and said detecting section, one end of said power indicating optical fiber being disposed within said power indicating window, an opposite end of said power indicating optical fiber being optically connected to said power indicating light emitting device.

2. A detector for a sewing machine as claimed in claim 1, wherein:

said photoelectric translation processing module section further includes light emitting devices, light receiving devices and a signal processing circuit;

said detecting section further comprises a light shielding/transmitting disc assembly comprising at least one flat sheet-shaped light shielding/transmitting disc, disposed coaxially on a mounting shaft adaptable to rotate in engagement with a shaft of said sewing machine and having portions for shielding and transmitting light directed therethrough; and said cable section further comprises light sending optical fibers and light receiving optical fibers optically connecting said light emitting devices and said light receiving devices, respectively, with said detecting section.

3. A detector for a sewing machine, as claimed in claim 2, wherein said detecting section further includes stationary reflecting areas positioned on opposite sides of said light shielding/transmitting disc assembly for reflecting light from said light sending optical fibers towards said light shield/transmitting discs and said light receiving optical fibers.

4. A detector for a sewing machine, as claimed in claim 3, wherein said light sending optical fibers and light receiving optical fibers are disposed substantially linearly within said detecting section, said reflecting areas being disposed, respectively, at a predetermined angle to and opposite of end faces of said light sending optical fibers and said light receiving optical fibers.

5. A detector for a sewing machine, as claimed in claim 4, wherein said detecting section further includes an optical fiber supporter for integrally securing said reflecting areas, said light sending optical fibers and said light receiving optical fibers.

6. A detector for a sewing machine, as claimed in claim 3, wherein said detecting section further includes an optical fiber supporter for integrally securing said reflecting areas, said light sending optical fibers, and said light receiving optical fibers.

7. A detector for a sewing machine as claimed in claim 1, wherein:

said photoelectric translation processing module section further comprises light emitting devices, light receiving devices, and a signal processing circuit;

said detecting section further includes a light shielding/transmitting assembly comprising at least one light shielding/transmitting element, disposed on a mounting shaft adaptable to rotate in engagement with a shaft of said sewing machine and having portions for shielding and transmitting light; and said cable section further includes light sending optical fibers and light receiving optical fibers optically connecting said light emitting devices and said light receiving devices, respectively, with said detecting section.

8. A detector for a sewing machine as claimed in claim 7, wherein said light shielding/transmitting disc assembly comprises first, second and third flat sheet-shaped light shielding/transmitting elements, said first light shielding/transmitting element being fixedly secured to said mounting shaft, and having an angle setting scale and corresponding angle indications thereon, and said second and third light shielding/transmitting elements being rotatably mounted on said mounting shaft and each having an indicator thereon for indicating a relative position with respect to each other and said first element.

9. A detector for a sewing machine, as claimed in claim 2, wherein said discs are optically coupled to said cable section for producing optical signals indicative of at least one of a sewing machine speed, a needle up position, a needle down position and a thread timing position.

10. A detector for a sewing machine as claimed in claim 2, wherein said light shielding/transmitting disc assembly comprises first, second and third flat sheet-shaped light shielding/transmitting discs, said first light shielding/transmitting disc being fixedly secured to said mounting shaft, and having an angle setting scale and corresponding angle indications thereon, and said second and third light shielding/transmitting discs being rotatably mounted on said mounting shaft and each having an indicator thereon for indicating a relative position with respect to each other and said first disc.

11. A detector for a sewing machine, as claimed in claim 10, wherein said indicator on said second and third discs and said angle setting scale are printed in different colors for differentiating said first, second and third discs.

* * * * *